US006241135B1

(12) United States Patent
Thatcher

(10) Patent No.: US 6,241,135 B1
(45) Date of Patent: Jun. 5, 2001

(54) PACK SYSTEM FOR HOLDING HIGHLY VISCUS FLUIDS

(75) Inventor: Bryce Thatcher, Rexburg, ID (US)

(73) Assignee: Ultimate Direction, Inc., Rexburg, ID (US)

( * ) Notice: Subject to any disclaimer, the term of this patent is extended or adjusted under 35 U.S.C. 154(b) by 0 days.

(21) Appl. No.: 09/325,124

(22) Filed: Jun. 3, 1999

Related U.S. Application Data

(63) Continuation of application No. 08/911,178, filed on Aug. 14, 1997, now abandoned.

(51) Int. Cl.[7] ..... A45F 3/16; A45F 5/00

(52) U.S. Cl. ..... 224/148.5; 224/148.4; 224/148.7; 222/175; D3/229

(58) Field of Search ..... 224/148.1, 148.4, 224/148.5, 148.6, 148.7, 904, 660, 664, 676, 677; 222/175; D3/229, 228

(56) References Cited

U.S. PATENT DOCUMENTS

| | | | |
|---|---|---|---|
| D. 208,289 | | 8/1967 | Feuerer . |
| 2,494,632 | | 1/1950 | Rodin . |
| 4,197,890 | | 4/1980 | Simko . |
| 4,420,097 | | 12/1983 | Mostenbocker . |
| 4,776,546 | | 10/1988 | Goldson et al. . |
| 4,828,154 | | 5/1989 | Clifton, Jr. . |
| 4,948,023 | | 8/1990 | Tripp . |
| 4,966,321 | | 10/1990 | Outlaw . |
| 5,114,059 | | 5/1992 | Thatcher . |
| 5,148,949 | | 9/1992 | Luca . |
| 5,240,156 | | 8/1993 | Sicotte et al. . |
| 5,582,335 | | 12/1996 | Beard et al. . |
| 5,890,636 | * | 4/1999 | Kibbe ..... 224/148.6 |
| 6,045,020 | * | 4/2000 | Rassier et al. ..... 224/148.5 X |

* cited by examiner

*Primary Examiner*—Gregory M. Vidovich
(74) *Attorney, Agent, or Firm*—Malcolm B. Wittenberg

(57) ABSTRACT

A pack system for holding a highly viscous liquid includes a container configured with an opening in the bottom end thereof, a valve mechanism disposed adjacent the opening for selectively controlling flow through the opening, and a pack having a pocket configured to hold the container in an upright position so that highly viscous liquid disposed within the container will gravitate toward the opening in the lower end. Preferably, the pocket has an opening in the upper end for receiving the container and an opening in the lower end for receiving the valve mechanism so that the valve mechanism is visible while the container is in the pocket.

8 Claims, 3 Drawing Sheets

PACK SYSTEM FOR HOLDING HIGHLY VISCUS FLUIDS

This application is a continuation of Ser. No. 08/911,178 filed Aug. 14, 1997, abandoned.

BACKGROUND OF THE INVENTION

1. Field of the Invention

The present invention relates to a pack for holding fluid containers. More particularly, the present invention relates to a pack system which has a pack configured to hold one or more fluid containers so that the opening of the fluid container(s) is disposed at the bottom to thereby encourage highly viscus fluids contained in the container to be disposed adjacent the opening and ready for use.

2. State of the Art

In recent years there has been a tremendous increase in the popularity of many outdoor sporting activities such as bicycling (on-road and mountain biking), hiking, rock climbing, kayaking, long distance running, etc. Most of these activities are conducted in somewhat remote areas or under conditions in which it is inconvenient for the participant to eat or drink from conventional sources. In some activities, such as races, it is desirable that the athlete be able to eat or drink while continuing to run, cycle, etc. Thus, it is often necessary for athletes engaged in such activities to carry their own food and water and to access that food/water while continuing to engage in the activity.

Because of the growth in such activities and the need for food and liquids during strenuous exercise, there has been a significant increase in the use of foods which are specially formulated to give the athlete the food or liquid needed. Along these lines, there has been a significant increase in the use of specialized liquid foods, such as carbohydrate gels. The carbohydrate gels provide the necessary nutrients typically acquired from solid foods, but are more easily absorbed by the body during strenuous exercise. Thus, the risk of cramping is significantly reduced.

Unfortunately, the carbohydrate gels are highly viscous. In other words, the gels have a significant resistance to flow. Typically, the gels are of a consistency which is similar to that of honey. Unless a bottle is nearly full, the user must either shake the bottle or hold the bottle upside-down to get the carbohydrate gel out the opening. The additional time and awkward body movements which are currently required to use the gels limits the advantages which can be obtained from the additional carbohydrates.

While a carbohydrate gel container may be placed with the opening down in the pocket of a conventional pack, there are several practical concerns which limit such a solution. First, it is critical that the user of the gel be able to access the contents of the container/bottle whenever necessary. Placing the small gel containers in a traditional pocket, however, allows the gel container to fall to either side and complicates retrieval of the container while the user is running, cycling, etc. Second, the user may not fully close the cap of the container. This can result in the leakage of the gel into the pack. Of course, the user is usually unable to see the leak until most of the gel has escaped, or until he or she reaches for the container, only to find a sticky pool of gel in his or her pack. Runners, cyclists, etc., will often be unable to wash their hands for some time, and the viscous gel is nearly impossible to remove from the pack without washing.

Thus, there is a need for an improved packing system which is configured to hold a gel container in such a manner that the gel is constantly ready for use. Such a pack should preferably be configured to hold the gel container in such a position that the leakage of the gel container does not pool in the pack.

SUMMARY OF THE INVENTION

It is an object of the present invention to provide an improved pack system for holding highly viscous liquids.

It is another object of the present invention to provide a pack which is configured to receive one or more gel containers with the outlet opening positioned at the bottom of the container to maintain the gel adjacent the opening.

It is another object of the present invention to provide such a pack system wherein the pack is configured to prevent pooling of the gel within the pack in the event that the gel container is not properly closed.

The above and other objects of the invention not specifically enumerated are achieved by a pack system configured to holding highly viscus fluids in a container such that the semi-liquid material is readily available. The pack system includes a container for holding the highly viscous fluid, with a selectively closable opening disposed at or adjacent the bottom of the container. By having the opening in the bottom of the container, the highly viscous fluid remains adjacent the opening and ready for use without inverting or shaking the container.

The pack system also includes a container holder, typically in the form of a pack. The container holder includes a receptacle or pocket which is configured to hold the container in a substantially vertical or upright position so that the contents of the container are drawn by gravity toward the opening in the lower end.

In accordance with another aspect of the present invention, the receptacle is provided with an opening at or adjacent a bottom end thereof. The opening facilitates receipt of the container, and also prevents highly viscus material from pooling in the pack in the event the opening is not properly closed. If the container leaks, the contents will pass out of the hole. While a small amount may drip onto the user, the drip will alert the user to the open container and will enable corrective action before most or all of the material is gone.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
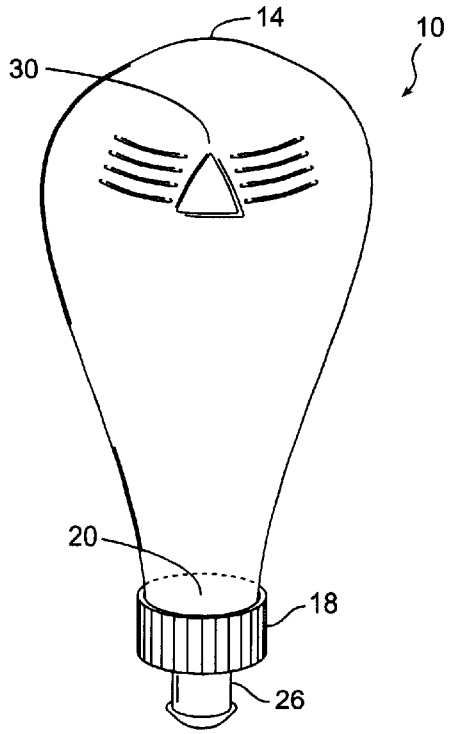
FIG. 1 shows a perspective view of a container made in accordance with the principles of the present invention for highly viscous liquids.

Referring to FIG. 1, there is shown a perspective view of a container, generally indicated at 10, made in accordance with the principles of the present invention. The container 10 is configured in the shape of a bottle with an upper portion 14 which is closed, broadly rounded, and which tapers outwardly toward a middle portion of the bottle. The container also includes a lower portion 18 which tapers inwardly toward an opening 20 in the lower end through which a highly viscous liquid, such as a carbohydrate gel, can flow.

A selectively closable valve 26 is attached to the lower portion of the container 10 so as to selectively cover the opening. Thus, the valve 26 provides the user with selective closure of the container and enables control as to when the highly viscous liquid is dispenced.

The valve 26 will typically be similar in configuration to those commonly used on bicycle water bottles and the like. However, depending on the viscosity of the liquid passing therethrough, the size of the opening may be increased to increase the volume of material which can be ejected from the container 10 in a short period of time.

While there are many container configurations which could be used with a highly viscous liquid, the common problem is that the container tends to be configured to have its opening disposed at the top. Because of the material's resistance to flow, however, the material remains in the bottom—opposite the opening. To get the viscous liquid to come out, the user must typically either hold the container upside down for a sufficient amount of time for the material to flow to the open end, or must try to shake the container 10 to accelerate movement of the material to the opening. Either of these approaches interferes with the user running, cycling, paddling, etc.

Figure 2:
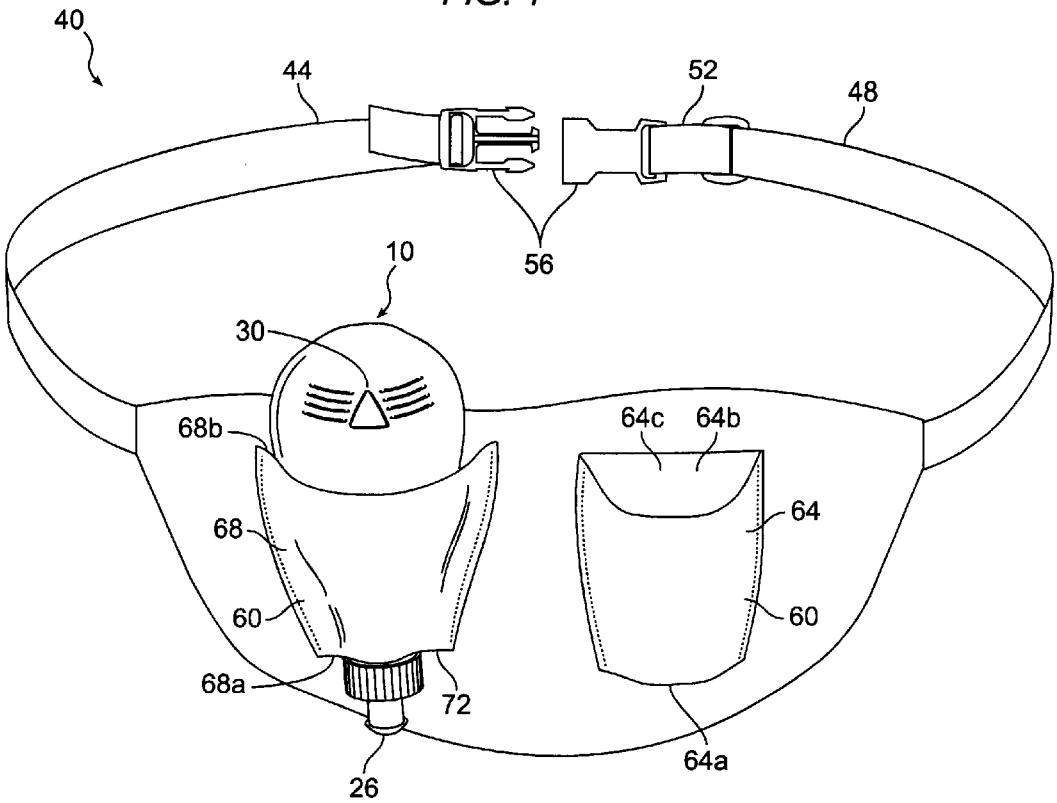
FIG. 2 shows a perspective view of a pack configured for holding the container shown in FIG. 1.

Turning now to FIG. 2 there is shown a pack system 40 which is configured to receive the container 10 of FIG. 1 so that a highly viscous fluid disposed therein remains ready for use. The pack system 40 includes a pack 44 which has an attachment mechanism 48, typically in the form of a belt 52, for attachment to the user. As shown in FIG. 2, the attachment mechanism 48 includes a buckle 56 with two sides that snap together to hold the belt 52 about the user.

Disposed on the pack 44 are a plurality of pockets 60. One of the pockets 64 has a closed bottom end 64*a*, and a flap 64*b* which covers a top end 64*c* to prevent contents from accidentally falling out. Such pockets are common in packs and should be well known to those skilled in the art.

The other pocket 68 has an opening 72 in the lower or bottom end 68*a*. The opening 72 is configured to receive at least a portion of the valve 26 so that a portion of the valve extends beyond the bottom of the pocket 68. The upper or top end 68*b* also is open to facilitate sliding of the container 10 into or out of the pocket.

Referring momentarily to FIGS. 1 and 2, a plurality of protrusions 30 are typically disposed on the upper portion 14 of the container 10 to assist the user in maintaining a grip on the container while it is slid into or out of the pocket 68. While numerous different tactile surfaces will work, a plurality of raised lines are simple to form and work well.

As shown in FIG. 2, the pocket 68 has a gradual inward taper from the top end 68*b* to the bottom end 68*a*. The inward taper preferably conforms to the inward taper on the lower portion of the container 10. The taper allows the container 10 to nest within the pocket so it will not come out too easily, and also helps to keep the container in a substantially vertical position. If the container 10 is allowed to lean too far in any one direction, the highly viscous liquid disposed therein may not be ready for use when the container is withdrawn from the pocket 68.

The embodiment of the invention shown in FIG. 2 has several advantages. First, the tapered pocket securely holds the container 10, but allows easy removal when the container is needed. Second, the opening 72 at the bottom of the pocket 68 helps to keep the pack 40 clean and enables the user to more quickly determine if the valve 26 of the container 10 has not been properly closed.

If the container 10 is used and not all of the carbohydrate gel, etc., has been sucked off of the valve 26, placing the container 10 into a pocket with a solid bottom will result in the often sticky liquid contacting the pocket. After numerous such contacts, the pocket will become sticky and leave a residue on the container 10 each time it is placed in the pocket. This residue, in turn, gets on the user's hands and makes use of the container 10 uncomfortable.

Additionally, if the valve 26 of the container 10 is not properly closed, the highly viscous liquid in the container will gradually leak out into the pocket. Not only is the user deprived of the carbohydrate gel, etc., but the pocket fills with the sticky liquid. The pack must then be cleaned. During race conditions and many back country situations, this is often impractical or impossible.

These concerns are resolved by the pack 40 configuration shown in FIG. 2. When the container 10 is disposed in the pocket 68, the valve 26 is generally held away from the sidewalls forming the pocket. Thus, any residue left on the valve 26 after use will generally not come into contact with the interior of the pocket 68. Additionally, if the valve 26 of the container 10 is not properly closed, it is much more likely that the situation will be noticed by the user because the valve will typically be visible. If leakage occurs, a small amount of the highly viscous liquid may fall onto the leg of the user before the leak is noticed. Once discovered, however, the valve 26 can be properly closed. Very little carbohydrate gel, etc., is lost, and the pack remains substantially clean.

Figure 3:
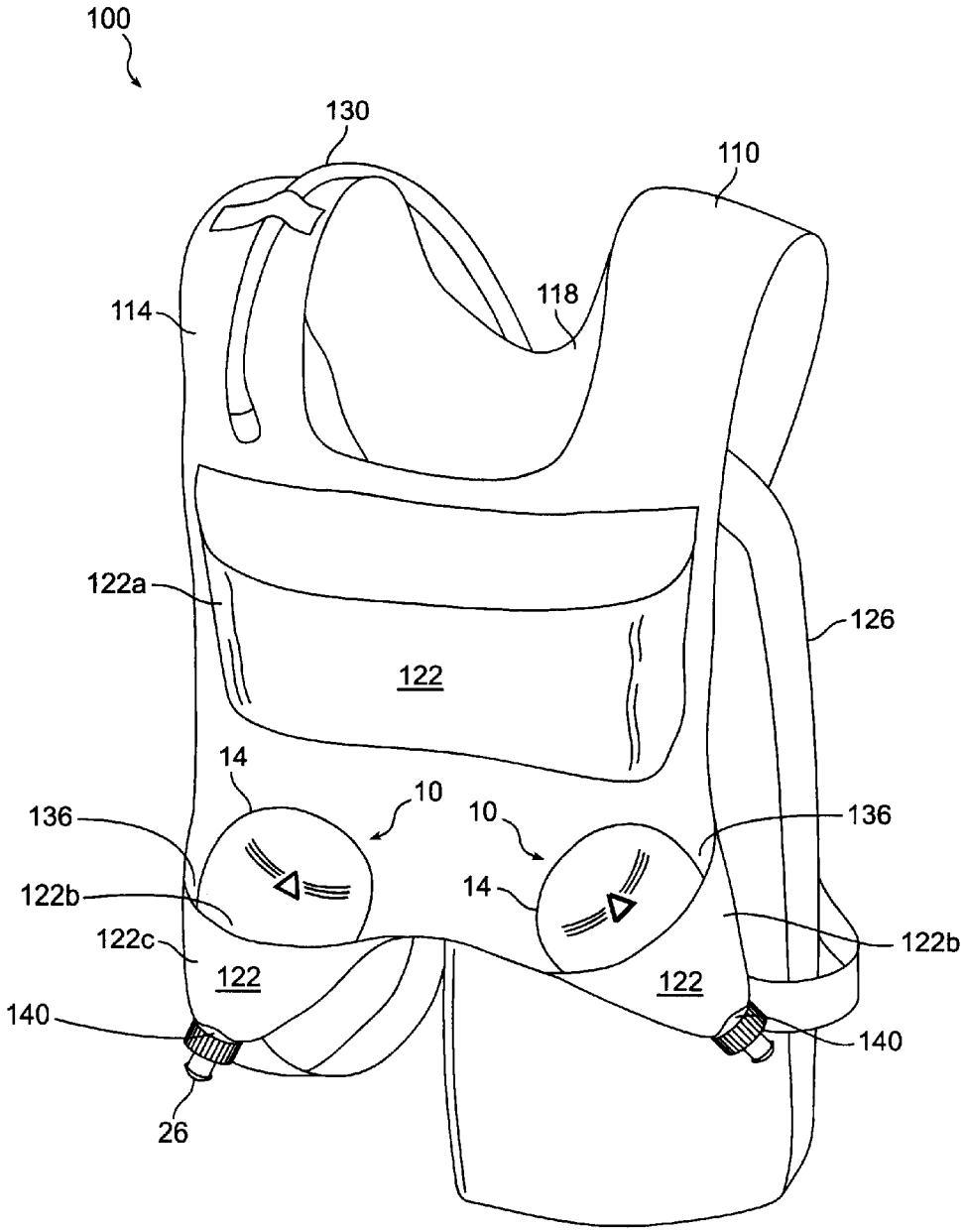
FIG. 3 shows a perspective view of an alternative version of a pack, in the form of a wearable vest.

Turning now to FIG. 3, there is shown a perspective view of an alternate embodiment of the invention. The pack system, generally indicated at 100, includes a pack 110 in the form of a vest 110. The vest 110 is configured with a front portion 114 and a rear portion 118. The front portion 114 has a plurality of pockets 122 disposed thereon, and the back portion 118 has a pouch 126 which is configured to hold a liquid supply bladder for holding water, sports drinks and the like. The liquid is provided to the user through a drinking tube 130 which is attached to the vest 110.

While the rear portion 118 holds a relatively large supply of water, etc., the pockets 122 of the front portion 114 are used to hold food such as protein bars and carbohydrate gels. Thus, the front portion has a first, larger pocket 122*a* disposed adjacent the chest, and two second, smaller pockets 122*b*. The smaller pockets are configured for receiving containers 10. More specifically, the smaller pockets have an opening 136 at the top thereof, and a second opening 140 at the bottom thereof. The upper opening 136 is configured to receive the bottle portion of the container 10, while the smaller, lower opening 140 is configured to receive the valve 26 in such a manner that the container is held substantially vertical. As used herein, substantially vertical means at an angle of 45 degrees or greater.

When the user desires to eat the contents of a container 10, he or she may simply slide the container out of the pocket 122*b* and squeeze. Because the container 10 is held substantially vertical, the highly viscous liquid in the container remains adjacent to the opening 20 (FIG. 1) and the valve 26. As the user squeezes, the liquid is immediately dispensed without the need for inverting the container 10 or shaking the container to move the liquid.

In accordance with another aspect of the invention, the left smaller pocket 122*c* is shown with an asymmetrical opening along the upper end of the sidewall which forms the pocket. The asymmetrical opening has been found to assist the user in withdrawing and replacing the container 10 without substantially decreasing the holding ability of the pocket.

Figure 4:
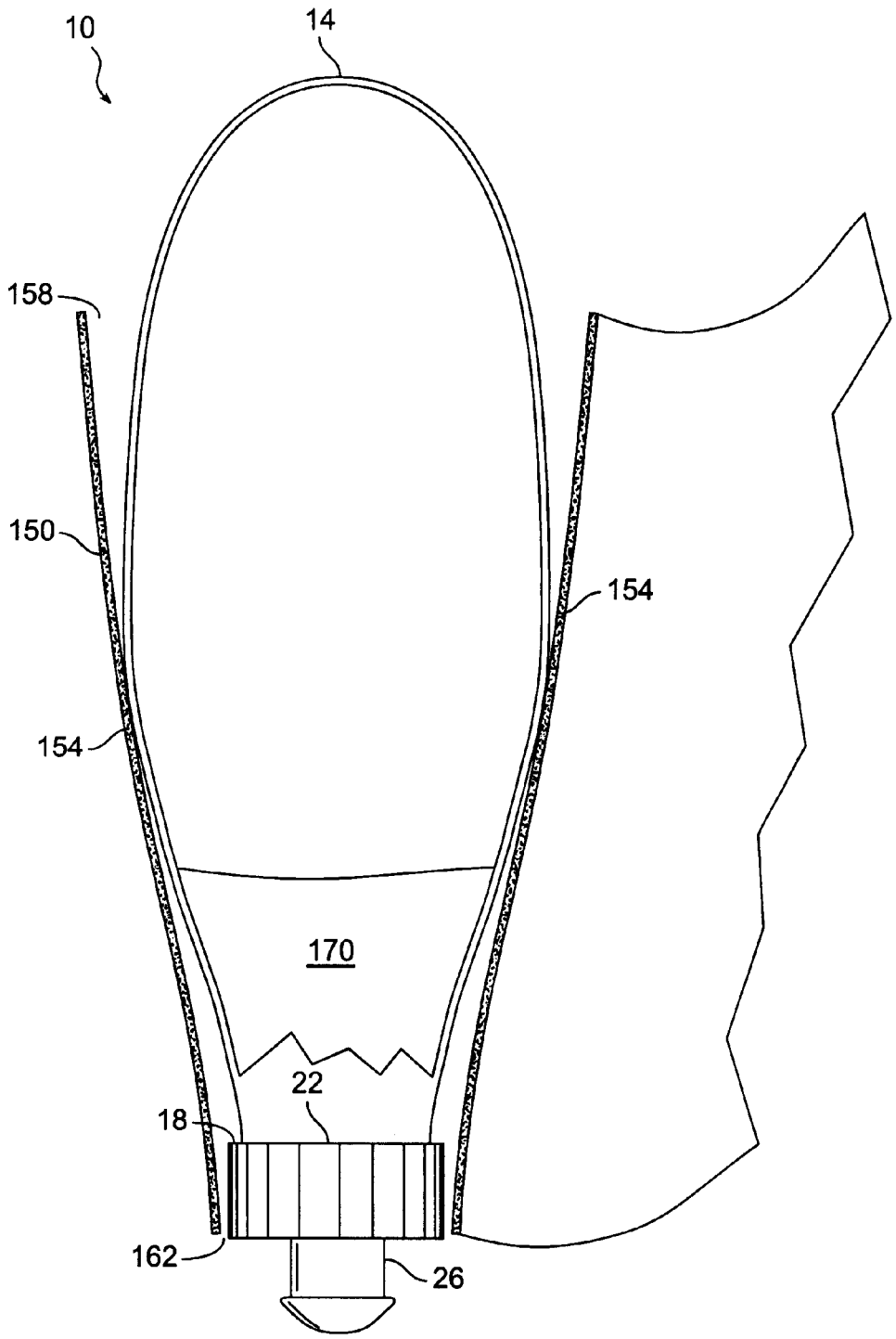
FIG. 4 shows a cross-sectional view of a pocket configured for receiving a container and a container disposed therein in accordance with the principles of the present invention.

Turning now to FIG. 4, there is shown a cross-sectional view of a pocket 150 with a container 10 disposed therein. The pocket 150 includes sidewalls 154 which define the pocket. The pocket has a first, larger opening 158 at the top thereof, and a second, smaller opening 162 at the bottom thereof. Preferably, the first and second openings 158 and 162 are disposed along a common vertical axis such that when the container 10 is slid into the pocket 150 so that the valve 26 extends into the second opening, the container is held vertical. In such a manner, the contents of the container 10, typically carbohydrate gel 170, are always gravity driven toward the opening 22 in the bottom end 18 of the container. In a less preferred alternative, the openings 158 and 162 and sidewalls 154 can be positioned to hold the container substantially vertical.

As shown in FIGS. 1 and 4, it is preferred that the sidewalls 154 are tapered, both on the front and back and on lateral sides. The funnel shape which is formed thereby helps to securely hold the container 10 in the desired position until the user grabs the upper portion 14 of the container 10 and withdraws it from the pocket 154.

While a funnel shape is desired, it is not necessary. Selective placement of the openings 158 and 162 could be used to ensure that the container 10 is held in the desired position.

Thus there is disclosed an improved pack system for highly viscous liquids. Those skilled in the art will appreciate numerous modifications which can be made without departing from the scope and spirit of the present invention. The appended claims are intended to cover such modifications.

What is claimed is:

1. A system for retaining and dispensing a highly viscous liquid, said system comprising:

(1) a pack for fitting over and being retained by an upper torso of a wearer, said pack having at least one pocket, said pocket having an upper opening and a lower opening;

(2) a highly viscous liquid intended to be consumed by said wearer; and (3) at least one container holding said highly viscous liquid, said container being characterized as being removable from and sized to fit within said at least one pocket, said at least one container having an upper end and lower end, the lower end having a container opening therein for allowing said highly viscous liquid to be dispensed and said at least one container being held by said at least one pocket such that said container opening extends below said lower opening and having a valve at the container opening of said at least one container for selectively preventing said highly viscous liquid from flowing out of the container opening and out of the at least one container.

2. The pack system for holding a highly viscous liquid in a ready to use state of claim 1, wherein the container has a tapered lower portion which tapers inwardly toward the container opening.

3. The pack system for holding a highly viscous liquid in a ready to use state of claim 1, wherein the container has a single opening.

4. The pack system for holding a highly viscous liquid in a ready to use state of claim 3, wherein the container has a rounded upper portion.

5. The pack system for holding a highly viscous liquid in a ready to use state of claim 1, wherein the at least one pocket has an upper end and a lower end and wherein the at least one pocket tapers inwardly from the upper end to the lower end.

6. The pack system for holding a highly viscous liquid in a ready to use state of claim 5, wherein the upper opening configured for receiving the container being formed in the upper end and the lower opening configured for receiving the valve therethrough.

7. The pack system for holding a highly viscous liquid in a ready to use state of claim 6, wherein the upper and lower openings are disposed along a common vertical axis so as to hold the container in a vertical position.

8. The pack system for holding a highly viscous liquid in a ready to use state of claim 7, wherein the pocket has sidewalls extending between the upper and lower openings, and wherein the sidewalls taper inwardly between the upper and lower openings.

* * * * *